US010487551B2

(12) United States Patent
Soloski et al.

(10) Patent No.: US 10,487,551 B2
(45) Date of Patent: Nov. 26, 2019

(54) ELECTRIC HINGE

(71) Applicant: Corbin Russwin, Inc., New Haven, CT (US)

(72) Inventors: Edward Soloski, Scranton, PA (US); Thomas Naples, Newington, CT (US); Kenneth Grant, Rocky Hill, CT (US)

(73) Assignee: ASSA ABLOY Accessories and Door Controls Group, Inc., Monroe, NC (US)

( * ) Notice: Subject to any disclaimer, the term of this patent is extended or adjusted under 35 U.S.C. 154(b) by 227 days.

(21) Appl. No.: 15/490,224

(22) Filed: Apr. 18, 2017

(65) Prior Publication Data

US 2017/0306674 A1 Oct. 26, 2017

Related U.S. Application Data

(60) Provisional application No. 62/327,074, filed on Apr. 25, 2016.

(51) Int. Cl.

| | |
|---|---|
| ***E06B 3/00*** | (2006.01) |
| ***E05D 11/00*** | (2006.01) |
| *E05D 3/02* | (2006.01) |
| *E05D 5/04* | (2006.01) |

(52) U.S. Cl.

CPC ..... *E05D 11/0081* (2013.01); *E05D 3/02* (2013.01); *E05D 5/04* (2013.01); *E05D 11/0054* (2013.01); *E05Y 2201/11* (2013.01); *E05Y 2400/654* (2013.01); *E05Y 2900/132* (2013.01)

(58) Field of Classification Search

CPC ..... E05D 11/00; E05D 3/02; E05D 11/0081; E05D 5/04; E05D 2003/025; E05D 11/0054; E05Y 2201/00; E05Y 2400/654; E05Y 2800/00; E05Y 2900/132; E05Y 2201/11; Y10T 16/555; Y10T 16/52; Y10T 16/557; Y10T 16/552

USPC ..... 16/386, 221, 223, 385; 439/31, 165; 49/506

See application file for complete search history.

(56) References Cited

U.S. PATENT DOCUMENTS

| | | | | |
|---|---|---|---|---|
| 3,838,234 | A | 11/1974 | Peterson | |
| 4,284,861 | A * | 8/1981 | Senften | E05D 11/00 200/61.7 |
| 4,412,711 | A | 11/1983 | Suska | |
| 4,839,939 | A | 6/1989 | O'Brien | |
| 5,586,895 | A | 12/1996 | Zehrung | |

(Continued)

*Primary Examiner* — Chi Q Nguyen

(74) *Attorney, Agent, or Firm* — DeLio Peterson & Curcio LLC; Thomas E. Ciesco

(57) ABSTRACT

A method for making an electric hinge comprising providing first and second hinge plates, each hinge plate having at least one knuckle and forming in each hinge plate an open slot extending from an edge distal from the knuckle and terminating at a mid-portion of the hinge plate to the knuckle. The open slot depth is less than the thickness of the hinge plate. The method includes drilling a hole from the terminus of each open slot to the knuckle of the hinge plate and passing a wire through the hole from the terminus of the open slot to the knuckle in the first hinge plate and from the knuckle of the second hinge plate to the corresponding terminus of the second hinge plate. The method includes mating the first and second hinge plates by inserting a hinge pin through the knuckle of each hinge plate to form the electric hinge.

4 Claims, 8 Drawing Sheets

(56) References Cited

U.S. PATENT DOCUMENTS

| | | | | |
|---|---|---|---|---|
| 5,727,960 | A * | 3/1998 | Zehrung | E05D 11/0081 16/223 |
| 7,824,200 | B2 * | 11/2010 | Bryla | E05D 11/0081 16/223 |
| 8,490,249 | B2 * | 7/2013 | Boegel-Poetter | E05D 11/0081 16/386 |
| 8,650,714 | B2 * | 2/2014 | Staude | E05D 11/0081 16/386 |
| 2010/0243314 | A1 * | 9/2010 | Bryla | E05D 11/0081 174/651 |

* cited by examiner

ELECTRIC HINGE

BACKGROUND OF THE INVENTION

1. Field of the Invention

This invention relates to door mounting hardware and in particular to a door hinge capable of facilitating electrical connection with hardware such as electric locks carried in the door.

2. Description of Related Art

The term "electric hinge" as used in the door hardware industry refers to a door, panel or window hinge which carries wires to transfer electrical power and/or information between the surrounding wall or frame and hardware carried on the door, such as electric locks, closers, openers and sensors. An electric hinge 20' according to the prior art as shown in FIG. 1 installs wires through small diameter holes 26', 28' that have been drilled within the thickness of and through the entire width of the hinge leaf or plate. The wiring hole ends at a hinge knuckle 22', typically at an end knuckle of one of the pair of hinge plates, so that the wires can pass through the pin hole in a knuckle on one plate of the hinge pair to the pin hole in an adjacent knuckle on the other hinge plate. The wiring holes generally extend at an angle to the hinge plate edge and centerline of the hinge pin to permit the wiring hole to avoid passing through a hinge plate mounting hole 60. Since the wiring hole must have a diameter significantly smaller than the thickness of the hinge, typically less than 0.10 in. (2.5 mm), the wiring holes require precise drilling or fixturing. A drill bit 8 which has a relatively large length to diameter ratio tends to walk when first contacting the edge of the hinge 21'. In addition, the removal of scrap chips from the drilling process through the entire width of the hinge plate also tends to be more difficult, taking extra time in the drilling procedure. Additionally, fishing the wires through the wiring hole becomes more difficult through longer wiring holes, especially considering that four wires may be required in each hole. Wires which include twisted pairs or twisted wire groups may make the running of the wires even more arduous. A process is needed for more efficiently drilling the wiring holes and running the wires through the hinge so that an electrical connection can be made from hardware in the door to hardware outside of the door, such as in the frame or other location.

SUMMARY OF THE INVENTION

Accordingly, the need exists to drill shorter passageways for running wiring for electric power or information, which would shorten the drilling time for the hinges, and improve manufacturing and installation efficiency as well as reduce process cycles and overall manufacturing time required.

Bearing in mind the problems and deficiencies of the prior art, it is therefore an object of the present invention to provide an electric hinge which does not require drilling a wiring hole through the entire width of a hinge plate.

It is another object of the present invention to provide an electric hinge which includes an easily installed cover and ferule to protect the wire(s) leading into and out of the hinge.

A further object of the invention is to provide an improved method of construction of electric hinges which increases manufacturing efficiency thereof.

It is yet another object of the present invention to provide an improved method of construction of electric hinges which reduces process cycles and time required for drilling.

Still other objects and advantages of the invention will in part be obvious and will in part be apparent from the specification.

The above and other objects, which will be apparent to those skilled in the art, are achieved in the present invention which is directed to a method for making an electric hinge comprising providing a first hinge plate having at least one knuckle, the first hinge plate having a thickness and forming an open slot extending from an edge of the first hinge plate distal from the knuckle and terminating at a mid-portion of the hinge plate to the knuckle, the open slot having a depth less than the thickness of the first hinge plate. The method includes drilling a hole from the terminus of the open slot within the thickness of first hinge plate to the knuckle, the hole being sufficient in diameter to allow a wire to pass therethrough and passing a wire through the hole from the terminus of the open slot to the knuckle. The method includes providing a second hinge plate having at least one knuckle for mating with the first hinge plate, the second hinge plate having a thickness and mating the first hinge plate with the second hinge plate by inserting a hinge pin through the at least one knuckle of the first and second hinge plates to form the electric hinge.

The method may also include forming a second open slot in the second hinge plate extending from an edge of the second hinge plate distal from the knuckle and terminating at a mid-portion of the hinge plate to the knuckle, the second open slot having a depth less than the thickness of the second hinge plate. The method may include drilling a hole from the terminus of the second open slot within the thickness of the second hinge plate to the knuckle, the hole being sufficient in diameter to allow a wire to pass therethrough and passing the wire through the knuckle of the second hinge plate and the hole to the terminus of the second open slot.

The method may further include providing an elongated slot cover and disposing the slot cover in the first hinge plate slot, the slot cover having a length and a width corresponding to length and width of the first hinge plate slot. The elongated slot cover may include a cover opening within the length thereof and a groove extending on an underside thereof from the cover opening to the drilled hole, and the method may include passing the wire from the cover opening and along the groove under the slot cover to the drilled hole. The elongated slot cover may have a ferule over the cover opening, and the method may include passing the wire through the ferule to the cover opening. The elongated slot cover may have opposite flanges contacting sides of the slot. The slot may be formed in the surface of the hinge plate to be placed against a door or door frame.

Another aspect of the invention is directed to an electric hinge comprising a first hinge plate having at least one knuckle, the first hinge plate having a thickness. The electric hinge includes an open slot extending from an edge of the first hinge plate distal from the knuckle and terminating at a mid-portion of the hinge plate to the knuckle, the open slot having a depth less than the thickness of the first hinge plate. The electric hinge also includes a hole from the terminus of the open slot within the thickness of first hinge plate to the knuckle, the hole being sufficient in diameter to allow a wire to pass therethrough. A wire extends through the hole from the terminus of the open slot to the knuckle. The electric hinge includes a second hinge plate having at least one knuckle mated with the first hinge plate, the second hinge plate having a thickness. A hinge pin is disposed through the at least one knuckle of the first and second hinge plates to form the electric hinge.

The electric hinge may also include a second open slot in the second hinge plate extending from an edge of the second hinge plate distal from the knuckle and terminating at a mid-portion of the hinge plate to the knuckle. The second open slot has a depth less than the thickness of the second hinge plate. A hole extends from the terminus of the second open slot within the thickness of the second hinge plate to the knuckle, the hole being sufficient in diameter to allow a wire to pass therethrough. The wire extends through the knuckle of the second hinge plate and through the hole of the second hinge plate to the terminus of the second open slot.

The electric hinge may further include an elongated slot cover disposed in the first hinge plate slot, the slot cover having a length and a width corresponding to length and width of the first hinge plate slot. The elongated slot cover may include a cover opening within the length thereof and a groove extending on an underside thereof from the cover opening to the drilled hole, such that the wire extends from the cover opening and along the groove under the slot cover to the hole. The elongated slot cover may include a ferule over the cover opening, with the wire passing through the ferule to the cover opening. The elongated slot may include opposite flanges contacting sides of the slot. The slot may be formed in the surface of the hinge plate to be placed against a door or door frame.

Another aspect of the invention is directed to a method of installing an electric hinge on a door or door frame. The method comprises providing an electric hinge having first and second hinge plates, with each hinge plate having at least one knuckle. An open slot extends from an edge of the hinge plate distal from the knuckle and terminates at a mid-portion of the hinge plate to the knuckle, the open slot having a depth less than a thickness of the hinge plate. A hole extends from the terminus of the open slot within the thickness of the hinge plate to the knuckle, the hole being sufficient in diameter to allow a wire to pass therethrough. A wire extends through the hole from the terminus of the open slot to the knuckle. A second hinge plate having at least one knuckle is mated with the first hinge plate, the second hinge plate having a thickness. A hinge pin is disposed through the at least one knuckle of the first and second hinge plates to form the electric hinge. The method also includes providing a pair of elongated slot covers having a length and a width corresponding to length and width of the hinge plate slots, the slot covers having a cover opening within the length thereof. The method then includes passing a wire through the hole and a knuckle of the first hinge plate and then through a knuckle and the hole of the second hinge plate, mating the knuckles of the first and second hinge plates. The method further includes installing a hinge pin through the mated knuckles of the first and second hinge plates. The method then includes passing each opposite end of the wire through the openings in one of the slot covers, securing the slot covers in the slots of the first and second hinge plates. The method further includes passing opposite ends of the wire into openings under hinge mounting areas of the door and door frame, wherein the openings are aligned with the respective slot cover openings and mounting the first and second hinge plates on the hinge mounting areas of the door or door frame. The elongated slot cover may include a ferule over the cover opening, and the method may include including passing the wire ends through the ferule to the cover opening.

Yet another aspect of the present invention is directed to a method for making a hinge plate for an electric hinge comprising providing a first hinge plate having at least one knuckle, the first hinge plate having a thickness, and forming an open slot extending from an edge of the first hinge plate distal from the knuckle and terminating at a mid-portion of the hinge plate to the knuckle. The open slot has a depth less than the thickness of the first hinge plate. The method further includes drilling a hole from the terminus of the open slot within the thickness of first hinge plate to the knuckle, with the hole being sufficient in diameter to allow a wire to pass therethrough.

The method may include providing an elongated slot cover and disposing the slot cover in the first hinge plate slot, the slot cover having a length and a width corresponding to length and width of the first hinge plate slot. The elongated slot cover may include a cover opening within the length thereof and a groove extending on an underside thereof from the cover opening to the drilled hole, with the groove being of sufficient size to receive the wire. The slot may be formed in the surface of the hinge plate to be placed against a door or door frame.

Another aspect of the invention is directed to a method for making an electric hinge comprising providing first and second hinge plates, each hinge plate having at least one knuckle and forming in each hinge plate an open slot extending from an edge distal from the knuckle and terminating at a mid-portion of the hinge plate to the knuckle. The open slot depth is less than the thickness of the hinge plate. The method includes drilling a hole from the terminus of each open slot to the knuckle of the hinge plate and passing a wire through the hole from the terminus of the open slot to the knuckle in the first hinge plate and from the knuckle of the second hinge plate to the corresponding terminus of the second hinge plate. The method includes mating the first and second hinge plates by inserting a hinge pin through the knuckle of each hinge plates to form the electric hinge.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

In describing the embodiments of the present invention, reference will be made herein to FIGS. 2-13 of the drawings in which like numerals refer to like features of the invention.

Figure 1:
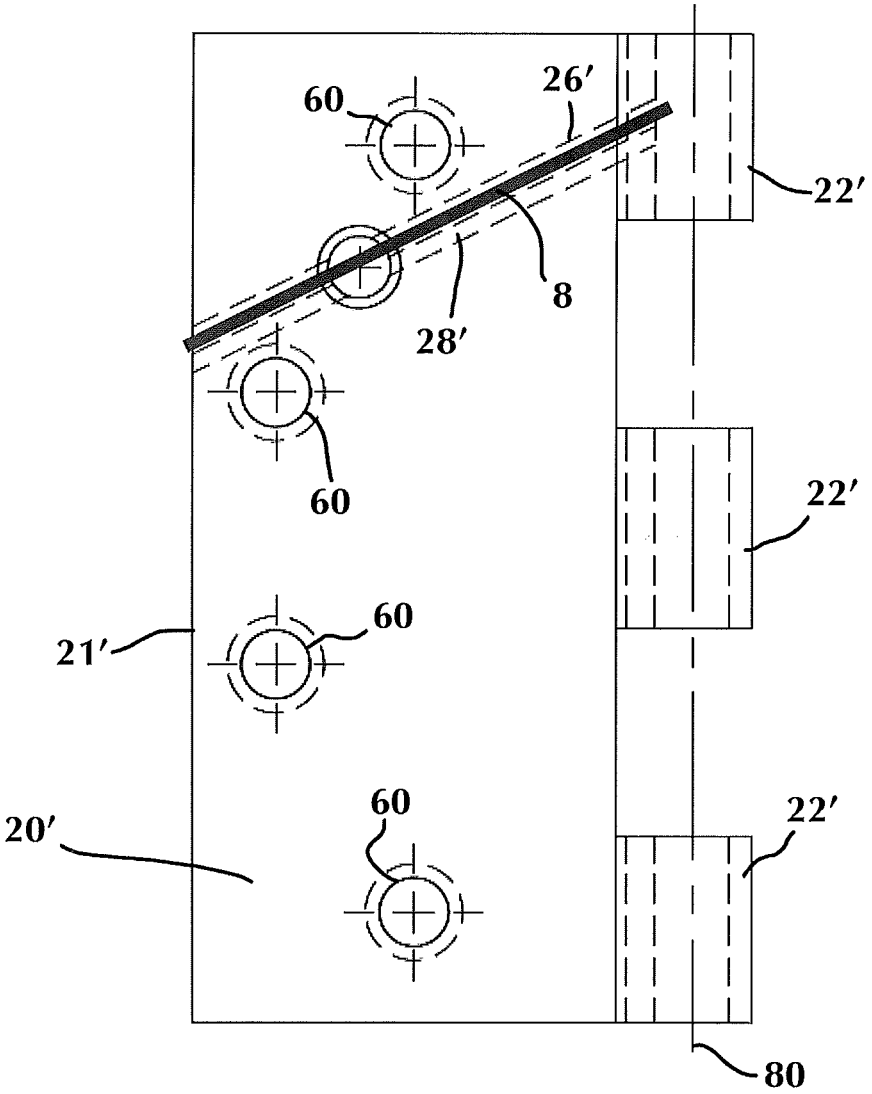
FIG. 1 (PRIOR ART)
FIG. 1 is a side elevational view of a prior art electric hinge plate.
Figure 2:
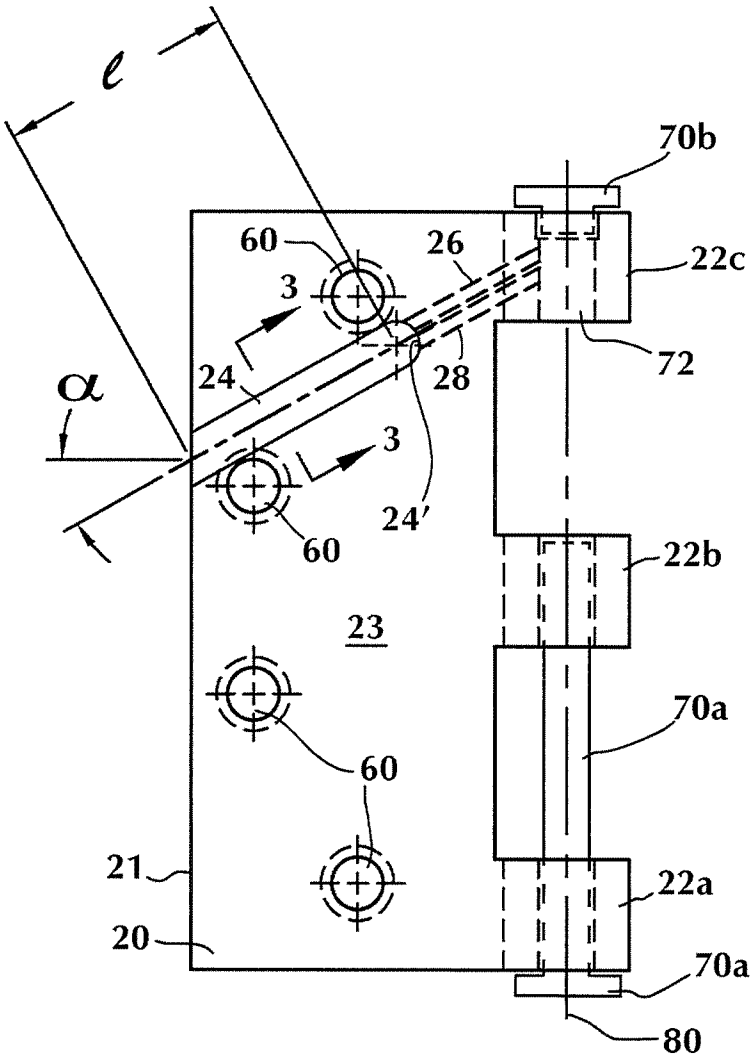
FIG. 2 is a side elevational view of an embodiment of one of a pair of electric hinge plates in accordance with the present invention.
Figure 3:
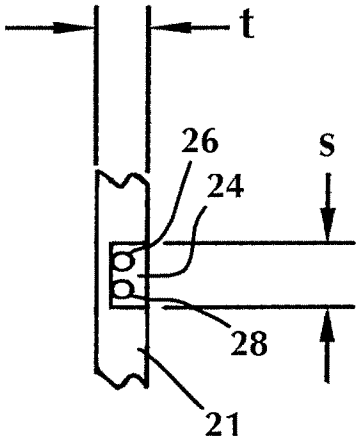
FIG. 3 is an edge view of the slot for carrying wires formed in the hinge plate of FIG. 2 along cut line 3-3.
Figure 5:
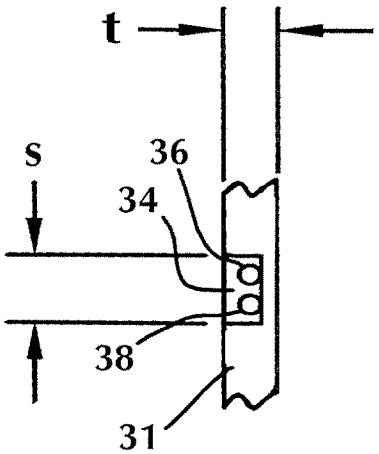
FIG. 5 is an edge view of the slot for carrying wires formed in the hinge plate of FIG. 4 along cut line 5-5.
Figure 4:
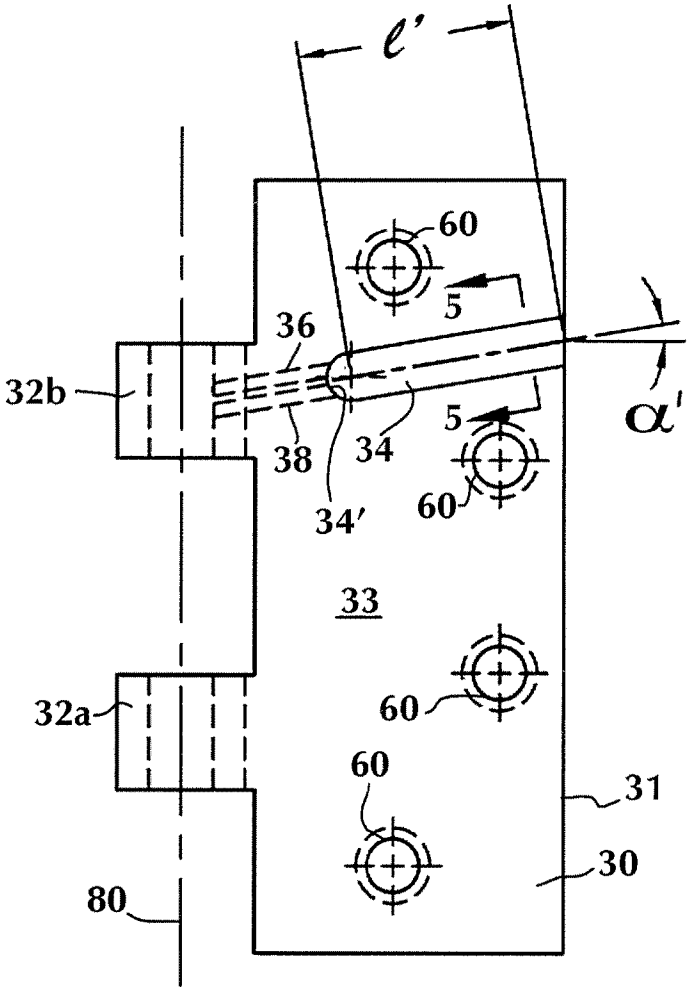
FIG. 4 is a side elevational view of an embodiment of the other the pair of electric hinge plates, for mating with the hinge plate of FIG. 1, in accordance with the present invention.
Figure 6:
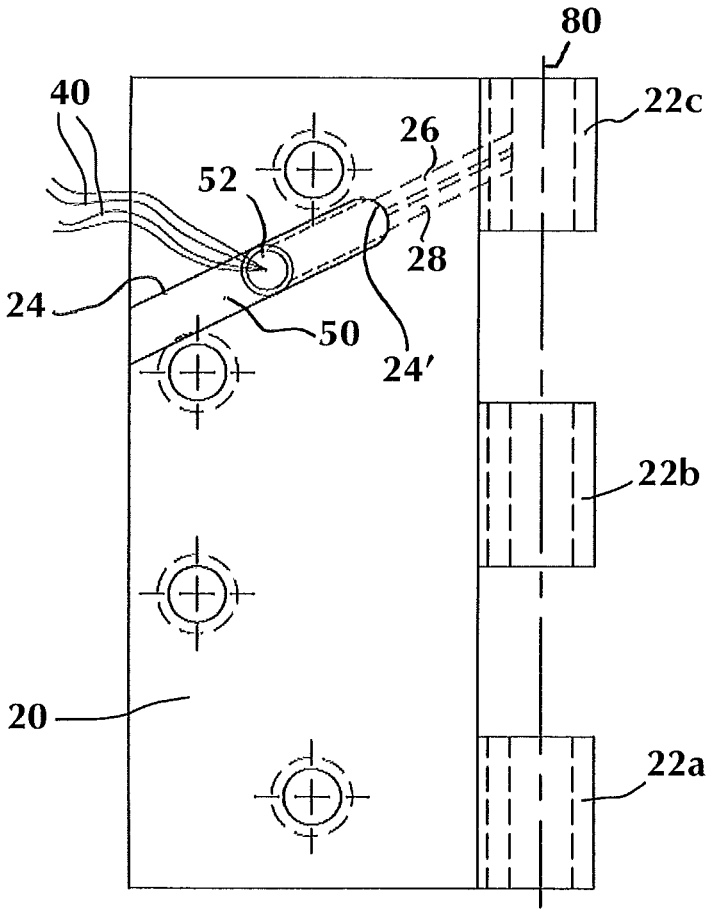
FIG. 6 is a side elevational view of an embodiment of the electric hinge plate of FIG. 2 showing the combined slot cover and wire ferule in accordance with the present invention.
Figure 8:
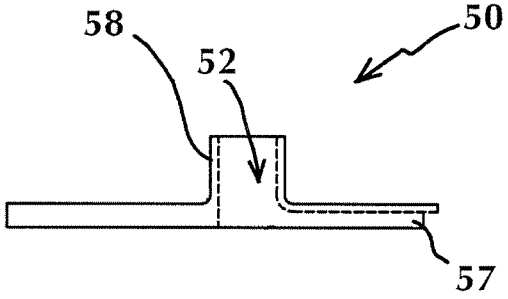
FIG. 8 is a side elevational view of the combined slot cover and wire ferule of FIG. 7.
Figure 10:
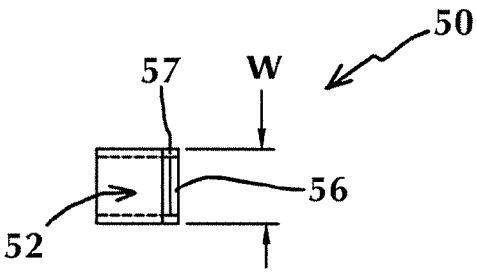
FIG. 10 is an end elevational view of the combined slot cover and wire ferule of FIG. 7.
Figure 7:
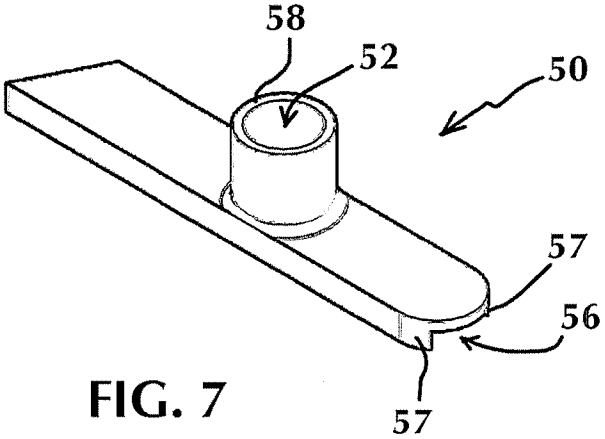
FIG. 7 is a perspective view of the combined slot cover and wire ferule of FIG. 6.
Figure 9:
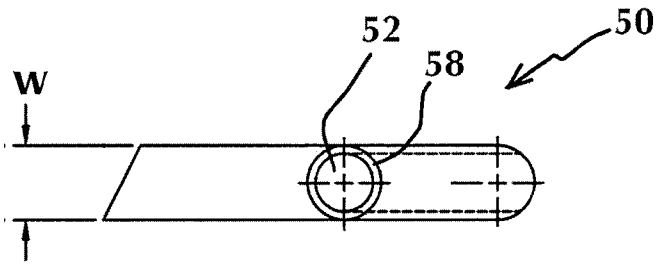
FIG. 9 is a top view of the combined slot cover and wire ferule of FIG. 7.
Figure 11:
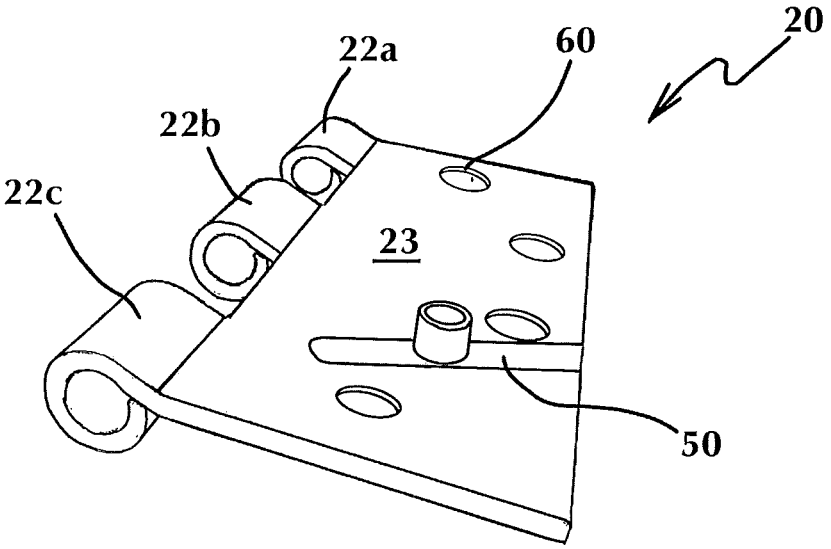
FIG. 11 is a perspective view of the electric hinge plate and combined slot cover and wire ferule of FIG. 6.

The present invention provides both an electric hinge and a method for making the electric hinge. As shown in FIGS. 2-4 and 12, the pin and barrel or knuckle-type electric hinge 10 includes hinge leaf or plate 20, 30, having mounting holes 60 for fastening the hinge plate with the surface shown placed flush against the door or door frame. Hinge plate 20 has door- or frame-contacting surface 23 and includes three knuckles 22*a*, 22*b*, 22*c* on one edge for receiving one or more hinge pins 70*a*, 70 in one or more of the knuckles, and distal edge 21 opposite the knuckles. Hinge plate 30 has door- or frame-contacting surface 33 and includes two knuckles 32*a*, 32*b* on one edge sized to be received between and mating with the knuckles of hinge plate 20, and distal edge 31 opposite the knuckles. Knuckles 22*a*, 22*b*, 22*c*, 32*a*, 32*b* have lengths shown sized to fit between each other, but different knuckle lengths may be employed, and bushings may be employed to fill spaces between adjacent knuckles of the opposite hinge plates. When the hinge pins are placed in or passed through the mated knuckles of the joined hinge plates (FIG. 12), the hinge plates rotate and swing about pin centerline 80. Each hinge plate 20, 30 in the embodiment shown includes an open slot 24, 34 formed on the surface of each plate that is intended to be placed against the door or door frame. The slot may be an open milled slot of depth less than the thickness t of the hinge plate (FIGS. 3 and 5), which extends across a portion of the width of the hinge plate from distal edge 21, 31. The opposite end or terminus of the slot 24', 34' is at a midpoint between the edge 21, 31 and the knuckles 22, 32. Milling slot 24, 34 with a flat tipped milling bit provides a round end surface 24', 34' at the end of the slot. The slot 24 may be at an angle $\alpha$ with respect to hinge edge 21 and pin centerline 80 (FIG. 2) for convenience in avoiding other features in the hinge, such a mounting hole 60, and for ensuring wire termination at a hinge knuckle 22. Similarly slot 34 may be at an angle $\alpha'$ with respect to hinge edge 31 and pin centerline 80 (FIG. 4) for convenience in avoiding other features in the hinge and for ensuring wire termination at a hinge knuckle 32. As shown in FIGS. 3 and 5, at the termini 24', 34' the depth of each slot 24, 34 may be at least the sum of the diameter of the wiring hole to be drilled and the spacing of the hole below the hinge plate surface 23, 33, and the width s of each slot is at least the diameter of the wiring hole, or if there are multiple holes, the sum of the diameters of the wiring holes and the spacing therebetween.

Following the formation of the open slot in the hinge plate, one or more wiring holes 26, 28 and 36, 38 may then be drilled from the slot ends 24', 34' to the knuckles 22*c*, 32*b*, respectively, within the thickness of the hinge plate. The lengths of slots 24, 34 may be more or less than the lengths of the drilled holes. The wiring holes 26, 28 in the electric hinge extend a distance shorter than in the prior art. As a result, the shorter hole is easier to drill considering the generally small diameter of the hole. For example, the length of the drilled wiring hole may be approximately 0.75 in. (19 mm), as opposed to the 2.25 in. length (57 mm) needed previously. Drilling the hole may be by any otherwise conventional method, such as by a rotating drill bit.

To protect the open slot, a plastic cover 50 having an opening 52 for the wires to pass there through may be provided for covering the slot, eliminating the need for the brass ferule as on prior art electric hinges. As shown in FIGS. 6-11, the cover 50 has a width sized to fit snugly in the width of slot 24 or 34, and a length corresponding to the length of the slot. Slot cover 50 may include at each side a downwardly extending flange 57 to contact the side and bottom of the slot and a bottom groove 56 at one end of its length between the flanges for the wires to pass from cover opening 52 to the beginning of wire hole(s) to the hinge knuckle. An upwardly extending ferule 58 may be integral and made of one piece with the slot cover adjacent cover opening 52, providing an easily installed exit point and protection for the wires into the door or door frame.

Figure 12:
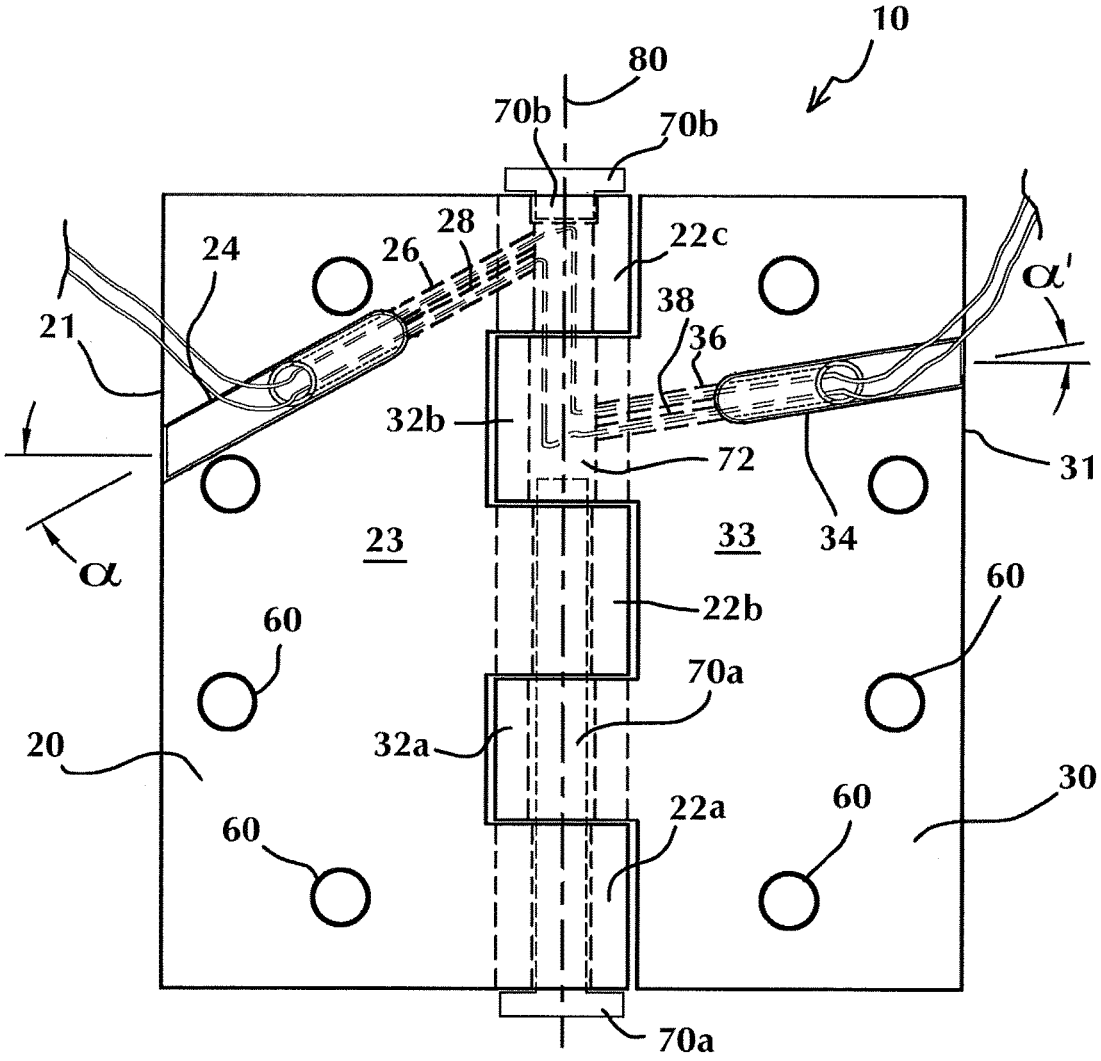
FIG. 12 is a side elevational view of an embodiment of an electric hinge made with the pair of hinge plates of FIGS. 2 and 4 in accordance with the present invention.

As shown in FIG. 12, hinge pin portions 70*a*, 70*b* are inserted from opposite ends to rotatably connect the hinge knuckles 22 to hinge knuckles 32, and may be in the two pieces as shown. A longer pin portion 70*a* may be disposed in a first end of the knuckle openings away from the wires, and a shorter pin portion 70*b* may be disposed in a second end of the knuckle openings closer to the wires. The shorter pin portion 70*b* may end before the hollow knuckle portion carrying the wire(s) 40 or may include a hollow portion 72, so that the wires may pass and extend through the drilled holes 26, 28 in hinge plate 20, the hollow portions of knuckle 22*c* and mating knuckle 32*b* and the drilled holes 36, 38 in the opposite hinge plate 30. In each hinge plate 20, 30 the wire(s) 40 also pass and extend through ferule 58, opening 52 and bottom groove 56 of plastic cover 50 set in hinge plate slots 24, 34.

Figure 13:
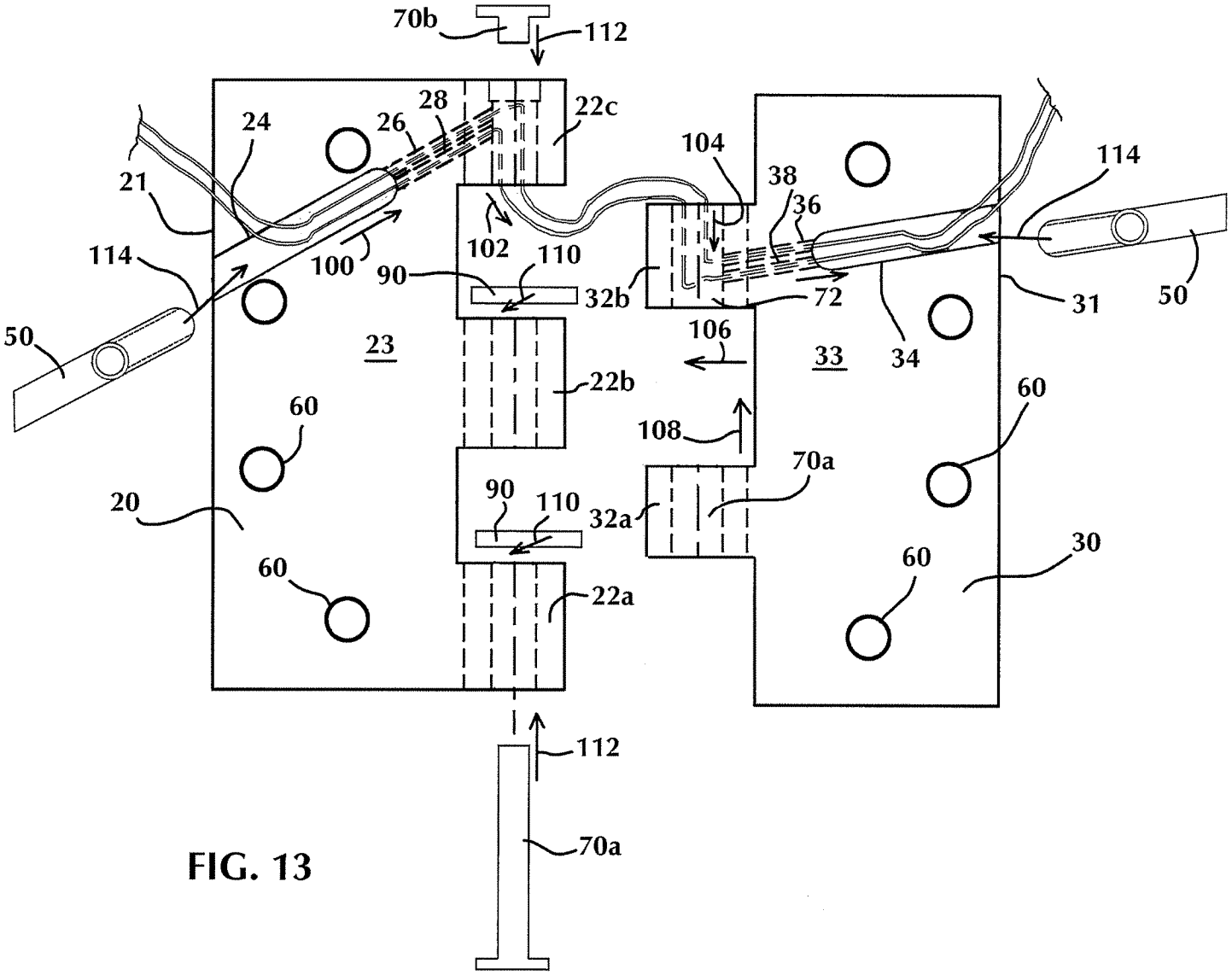
FIG. 13 is an exploded side elevational view showing one method of assembly of the electric hinge of FIG. 12.

To install the electric hinge of the present invention on a door or door frame, the electric hinge is typically installed as the center hinge in a three hinge arrangement, so that it does not bear the full torque forces of the door present at the uppermost and lowermost hinges. As shown in FIG. 13, in step 100 a pair of wires is passed through drilled holes 26, 28 in hinge plate 20 and in step 102 down through lower opening of knuckle 22*c*. After passing the wires in step 102 through knuckle 32*b* of the opposite hinge plate 30 and in step 104 through drilled holes 36, 38, the hinge plate 20 may be mated with the hinge plate 30 in step 106. In step 108 hinge plate 30 is shifted upward and bushings 90 are inserted in step 110 to fill spaces between adjacent knuckles 22*a*, 32*a* and 22*b*, 32*b* of the opposite hinge plates 20, 30. Hinge pins 70*a*, 70*b* inserted in step 112 through knuckles 22*a* and 22*c*, respectively, The opposite wire ends are passed through the ferules 58 in respective slot covers 50 for each of the hinge plates, secured within the bottom grooves 56, and the slot covers 50 are secured in the respective slots 24, 34 in step 114. The opposite ends of the wire(s) are passed into openings under the hinge mounting areas of the door and door frame, which openings are aligned with the respective slot cover openings. The hinge plates are then fastened to the hinge mounting areas of the door and door frame via fasteners in the hinge mounting holes. The wiring through the electric hinge may then supply power and/or information to or from devices installed in the door.

The hinge plates 20, 30 with the milled slots 24, 34 may be mated with each other to form a complete hinge, as shown in FIG. 12, or one or the other may be mated with another hinge plate with or without wiring holes made in accordance with the prior art.

Accordingly, the present invention provides an electric hinge which does not require drilling a wiring hole through the entire width of a hinge plate, and which includes an easily installed cover and ferule to protect the wire(s) leading into and out of the hinge. The method of construction according to the present invention increases manufacturing efficiency and reduces process cycles and time required for drilling.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of installing an electric hinge on a door or door frame comprising:

providing an electric hinge having first and second hinge plates each hinge plate having at least one knuckle, an open slot extending from an edge of the hinge plate distal from the at least one knuckle and terminating at a mid-portion of the hinge plate to the at least one knuckle, the open slot having a depth less than a thickness of the hinge plate, a hole from a terminus of the open slot within the thickness of the hinge plate to the at least one knuckle, the hole being sufficient in diameter to allow a wire to pass therethrough, the wire extending through the hole from the terminus of the open slot to the at least one knuckle; the second hinge plate having the at least one knuckle mated with the first hinge plate, the second hinge plate having a thickness; and a hinge pin disposed through the at least one knuckle of the first and second hinge plates to form the electric hinge;

providing a pair of elongated slot covers having a length and a width corresponding to length and width of the hinge plate slots, the slot covers having a cover opening within the length thereof;

passing the wire through the hole and the at least one knuckle of the first hinge plate and then through the at least one knuckle and the hole of the second hinge plate;

mating the knuckles of the first and second hinge plates;

installing the hinge pin through the mated knuckles of the first and second hinge plates;

passing each opposite end of the wire through the openings in one of the slot covers;

securing the slot covers in the slots of the first and second hinge plates;

passing opposite ends of the wire into openings under hinge mounting areas of the door and door frame, the openings being aligned with respective slot cover openings; and mounting the first and second hinge plates on the hinge mounting areas of the door or door frame.

2. The method according to claim 1 wherein the elongated slot cover further includes a ferule over the cover opening, and including passing the wire ends through the ferule to the cover opening.

3. The method according to claim 1 wherein the elongated slot cover further includes opposite flanges contacting sides of the slot.

4. The method according to claim 1 wherein the slot is formed in the surface of the hinge plate to be placed against a door or door frame.

* * * * *